US012516603B2

(12) United States Patent
Miller et al.

(10) Patent No.: US 12,516,603 B2
(45) Date of Patent: Jan. 6, 2026

(54) ENHANCED M-ARY ENCODING TELEMETRY

(71) Applicant: ERDOS MILLER, INC., Houston, TX (US)

(72) Inventors: Kenneth Miller, Houston, TX (US); David Erdos, Houston, TX (US); Abraham Erdos, Houston, TX (US)

(73) Assignee: ERDOS MILLER, INC., Houston, TX (US)

( * ) Notice: Subject to any disclaimer, the term of this patent is extended or adjusted under 35 U.S.C. 154(b) by 169 days.

(21) Appl. No.: 18/554,039

(22) PCT Filed: Apr. 7, 2022

(86) PCT No.: PCT/US2022/023822

§ 371 (c)(1),
(2) Date: Oct. 5, 2023

(87) PCT Pub. No.: WO2022/216924

PCT Pub. Date: Oct. 13, 2022

(65) Prior Publication Data

US 2024/0191620 A1 Jun. 13, 2024

Related U.S. Application Data

(60) Provisional application No. 63/172,348, filed on Apr. 8, 2021.

(51) Int. Cl.
*E21B 47/16* (2006.01)
*E21B 47/18* (2012.01)

(52) U.S. Cl.
CPC ..... *E21B 47/16* (2013.01); *E21B 47/18* (2013.01); *E21B 2200/22* (2020.05)

(58) Field of Classification Search
None
See application file for complete search history.

(56) References Cited

U.S. PATENT DOCUMENTS

2010/0188253 A1* 7/2010 Shearer ..... H04L 25/4902 340/853.3
2010/0195442 A1 8/2010 Reyes et al.
(Continued)

OTHER PUBLICATIONS

Ivanov et al., "Soft Decision Decoding in Mud Pulse Telemetry System", IEEE, 2020, 5 pages, retrieved on Jul. 25, 2022, https://ieeexplore.ieee.org/stamp/stamp.jsp?tp=&arnumber=9129046.
(Continued)

*Primary Examiner* — Quan Zhen Wang
*Assistant Examiner* — Jerold B Murphy
(74) *Attorney, Agent, or Firm* — Dickinson Wright PLLC

(57) ABSTRACT

In one embodiment, a telemetry controller may be configured to operate in any suitable combination of modes including pulse overdrive, multi-baud rate encoding, and/or high-resolution M-Ary encoding. Further, in some embodiments, an artificial intelligence engine may generate one or more machine learning models trained to operate in any of the combination of modes based on one or more parameters (e.g., condition of a downhole device, condition of a telemetry channel, condition of a well in which the downhole device is disposed, weather condition, condition of another system, or some combination thereof).

19 Claims, 13 Drawing Sheets

(56) References Cited

U.S. PATENT DOCUMENTS

| | | | | |
|---|---|---|---|---|
| 2010/0212963 | A1 | 8/2010 | Gopalan et al. | |
| 2016/0108716 | A1 | 4/2016 | Brown-Kerr et al. | |
| 2016/0362940 | A1 | 12/2016 | Petrovic et al. | |
| 2020/0040723 | A1 | 2/2020 | Miller et al. | |
| 2020/0378245 | A1 | 12/2020 | Miller et al. | |
| 2022/0106874 | A1* | 4/2022 | Lie | E21B 47/20 |
| 2022/0195868 | A1* | 6/2022 | Chen | G06N 20/00 |
| 2022/0316326 | A1* | 10/2022 | Lie | E21B 47/20 |

OTHER PUBLICATIONS

International Searching Authority, Search Report and Written Opinion for International Application No. PCT/US2022/023855, Date of Mailing Aug. 11, 2022, 11 pages.

* cited by examiner

ENHANCED M-ARY ENCODING TELEMETRY

CROSS REFERENCE TO RELATED APPLICATIONS

This application is a U.S. National Phase patent application of International Patent Application No. PCT/US2022/023822 filed Apr. 7, 2022, which claims priority to and the benefit of U.S. Prov. Pat. App. No. 63/172,348, filed Apr. 8, 2021, titled "ENHANCED M-ARY ENCODING TELEMETRY," the entire disclosures of which are hereby incorporated by reference for all purposes.

TECHNICAL FIELD

This disclosure relates generally to measurement-while-drilling (MWD) data and, in particular, to enhanced MWD decoding using artificial intelligence.

BACKGROUND

One problem encountered with MWD data provided by mud pulse (MP) telemetry is a tradeoff between data rate and magnitude of a pressure pulse. For example, a larger pulse width provides a larger pressure pulse at surface, since the main valve is closed longer, but it also slows down the data rate. Whereas a shorter pulse width gets you a faster data rate but reduces the magnitude of the pressure pulse received at surface. Another problem encountered with MWD data is that there are different signal to noise ratios during different operating modes. Yet another problem encountered with MWD data is the amount of data contained in a data packet is constrained using a certain M-Ary encoding scheme.

SUMMARY

In one embodiment, a system is disclosed. The system may include a tool drill string having a downhole device, the system comprising: a surface processor; a telemetry controller communicatively coupled to the surface processor; and a pulser configured to actuate to transmit one or more pressure pulses to the surface processor, wherein the pulser is communicatively coupled to the telemetry controller, and the telemetry controller is configured to: set a data rate for the one or more pressure pulses, wherein the data rate has a plurality of time slots having configured time units; set a first pulse width for the one or more pressure pulses to be transmitted at the data rate; receive a pulse overdrive request from the surface processor, wherein the pulse overdrive request comprises a percentage by which to increase the first pulse width; modify the first pulse width to a second pulse width for the one or more pressure pulses to be transmitted at the data rate, wherein the second pulse width is wider than the first pulse width; and control, via one or more commands, the pulser to transmit the one or more pressure pulses using the second pulse width and the data rate.

In some embodiments, a system is disclosed. The system may include a tool drill string having a downhole device, the system comprising: a surface processor; a telemetry controller communicatively coupled to the surface processor; and a pulser configured to actuate to transmit one or more pressure pulses to the surface processor, wherein the pulser is communicatively coupled to the telemetry controller, and the telemetry controller is configured to: set a first data rate for the one or more pressure pulses to encode a first information sequence; control, via a command, the pulser to transmit the first information sequence encoded in the one or more pulses to the surface processor; responsive to the first information sequence encoded in the one or more pulses being transmitted to the surface processor, modify the first data rate to a second data rate for the one or more pressure pulses to encode a second information sequence; control, via a second command, the pulser to transmit the second information sequence encoded in the one or more pulses to the surface processor.

In some embodiments, a system is disclosed. The system may include a tool drill string having a downhole device, the system comprising: a surface processor; a telemetry controller communicatively coupled to the surface processor; and a pulser configured to actuate to transmit one or more pressure pulses to the surface processor, wherein the pulser is communicatively coupled to the telemetry controller, and the telemetry controller is configured to: modify a data window of a data frame, wherein the data window comprises a plurality of time units and the telemetry controller modifies the data window by dividing each time unit of the plurality of time units by a certain amount; and control, via a command, the pulser to transmit a pressure pulse at a position in the data frame in increments having the certain amount instead of the plurality of time units.

In one embodiment, a tangible, non-transitory computer-readable medium may store instructions that, when executed, cause a processing device to perform any of the methods, operations, and/or functions described herein.

In one embodiment, a system may include a memory device storing instructions, and a processing device communicatively coupled to the memory device. The processing device may execute the instructions to perform any of the methods, operations, and/or functions described herein.

Other technical features may be readily apparent to one skilled in the art from the following figures, descriptions, and claims. These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the present disclosure. As used in the specification and in the claims, the singular form of 'a', 'an', and 'the' include plural referents unless the context clearly dictates otherwise.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), solid state drives (SSDs), flash, or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

BRIEF DESCRIPTION OF THE DRAWINGS

For a more complete understanding of this disclosure and its advantages, reference is now made to the following description, taken in conjunction with the accompanying drawings, in which.

DETAILED DESCRIPTION

FIGS. 1 through 9, discussed below, and the various embodiments used to describe the principles of this disclosure are by way of illustration only and should not be construed in any way to limit the scope of the disclosure.

Techniques for enhanced M-Ary telemetry are disclosed.

A "word" may refer to 2-bits and when the word encodes more than two logical values it is M-Ary. If a word encodes two logical values (e.g., 0 and 1) it is binary. Values may be encoded using an M-Ary encoding scheme and may be transmitted to processing devices for decoding to determine the values at the processing devices.

Figure 1:
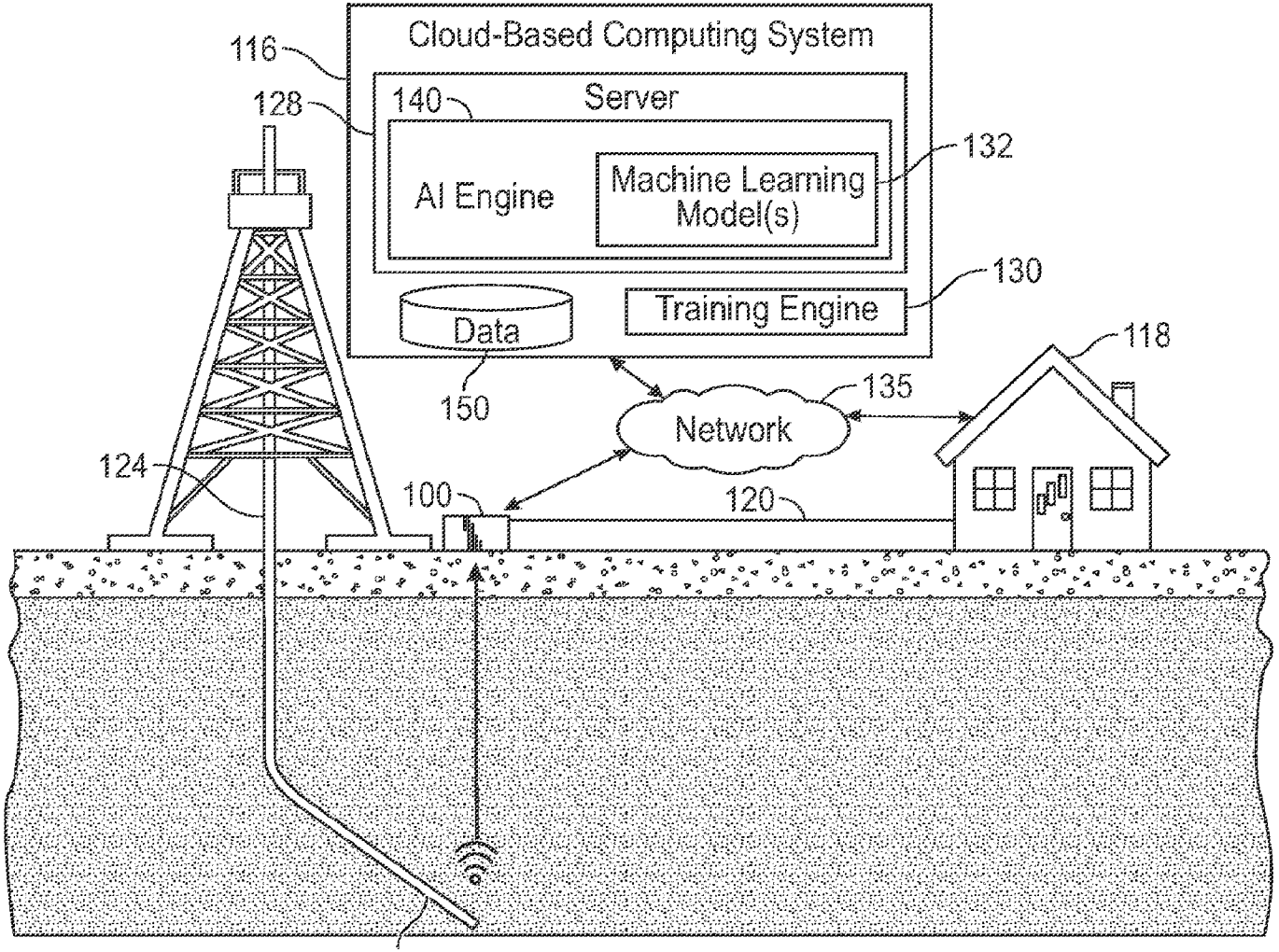
FIG. 1 is an illustration of a MWD system in a well sending data to a MWD data acquisition system, according to embodiments of the disclosure.

FIG. 1 shows the MWD data acquisition system 100 as placed next to an oil rig. The MWD data acquisition system 100 includes at least one data reception device. In some embodiments, there may be more than one data reception device. The data reception device may include various components, such as an analog data reception circuit configured to receive analog MWD data from an MWD tool 12, an analog-to-digital conversion circuit configured to convert the analog MWD data to digital MWD data, a data transmission circuit configured to transmit analog and/or digital data to a surface computing device 118. In some embodiments, the surface computing device 118 may be local or remote from the MWD data acquisition system 100. For example, the MWD data acquisition system 100 may be locally communicatively connected, via a cable 120, to the surface computing device 118 or the MWD data acquisition system 100 may be remotely communicatively coupled, via a network 135, to the surface computing device 118. In some embodiments, the MWD data acquisition system 100 may be included as a component of the surface computing device 118. In some embodiments, the MWD data acquisition system 100 may include or be coupled to a component (e.g., pressure transducer) configured to receive the data sent from the MWD tool 12. In some embodiments, the MWD data acquisition system 100 is configured to transmit digital data to a surface computing device 118 via the cable 120 using, for example, one of the following cable and communication standards: RS-232, RS-422, RS-485, Ethernet, USB, or CAN bus. Network 135 may be a public network (e.g., connected to the Internet via wired (Ethernet) or wireless (WiFi)), a private network (e.g., a local area network (LAN) or wide area network (WAN)), or a combination thereof. Network 135 may also comprise a node or nodes on the Internet of Things (IOT).

The MWD tool 12 may be programmed with information such as which measurements to take and which data to transmit back to the surface. The MWD tool 12 may include a downhole processor (e.g., telemetry controller). Communicating data between the downhole processor (e.g., telemetry controller) and a surface processor (e.g., included in the surface computing device 118) may be performed using various types of telemetry. For example, mud pulse (MP) telemetry and/or electromagnetic (EM) telemetry.

In some embodiments, a cloud-based computing system 116 may be communicatively coupled, via the network 135, to the surface computing device 118 and/or the MWD data acquisition system 100. Each of the components included in the cloud-based computing system 116, the surface computing device 118, and/or the MWD data acquisition system 100 may include one or more processing devices, memory devices, and/or network interface cards. The network interface cards may enable communication via a wireless protocol for transmitting data over short distances, such as Bluetooth, ZigBee, NFC, etc. Additionally, the network interface cards may enable communicating data over long distances.

The surface computing device 118 may be any suitable computing device, such as a laptop, tablet, smartphone, or computer. The surface computing device 118 may include a display capable of presenting a user interface of an application. The application may be implemented in computer instructions stored on the one or more memory devices of the surface computing device 118 and executable by the one or more processing devices of the surface computing device 118. The application 118 may present various user interfaces that present various configuration options to configure one or more settings, such as an overdrive percentage (e.g., 25%, 50%, 75%, 100%) that causes a pulse width of pressure pulses to increase by the overdrive percentage, set a survey baud rate (e.g., data rate) for pressure pulses, a sliding baud rate for pressure pulses, a rotating baud rate for pressure pulses, a high-resolution M-Ary encoding to enabled or disabled, and so forth. Any modification to the one or more settings may cause a downlink message to be transmitted from the surface processor to the telemetry controller during various modes of operating (e.g., off bottom where the tool drill string is not contacting the formation and on bottom where the drill string is drilling ahead and in contact with the formation). The surface computing device 118 may also include instructions stored on the one or more memory devices that, when executed by the one or more processing devices of the surface computing device 118, perform operations of any of the methods described herein.

In some embodiments, the cloud-based computing system 116 may include one or more servers 128 that form a distributed computing architecture. The servers 128 may be a rackmount server, a router computer, a personal computer, a portable digital assistant, a mobile phone, a laptop computer, a tablet computer, a camera, a video camera, a netbook, a desktop computer, a media center, any other device capable of functioning as a server, or any combination of the above. Each of the servers 128 may include one or more processing devices, memory devices, data storage, and/or network interface cards. The servers 128 may be in communication with one another via any suitable communication protocol. The servers 128 may execute an artificial intelligence (AI) engine 140 that uses one or more machine learning models 132 to perform at least one of the embodiments disclosed herein. The cloud-based computing system 128 may also include a database 150 that stores data, knowledge, and data structures used to perform various embodiments. For example, the database 150 may store a corpus of settings (e.g., pulse overdrive percentages, survey baud rates, sliding baud rates, high-resolution M-Ary encoding enable/disable setting, etc.) and various parameters (e.g., condition of the tool drill string, condition of the formation, condition of the weather, condition of a telemetry channel, etc.), and results that indicate which settings provided desired outcomes for which parameters. A condition of the weather may include "rain", "sunny", "cloudy", etc. The data stored in the database 150 may represent training data, in some embodiments. The training data may be used to train the machine learning models 132.

In some embodiments the cloud-based computing system 116 may include a training engine 130 capable of generating the one or more machine learning models 132. The machine learning models 132 may be trained to receive parameters related to various conditions (e.g., of the downhole device, of the telemetry channel, of the well in which the downhole device is disposed, of the weather, of another system, etc.), identify which setting (e.g., pulse overdrive percentages, survey baud rates, sliding baud rates, high-resolution M-Ary encoding enable/disable setting, etc.) provides a desired outcome for the parameters, output the identified settings, generate an overdrive request including the identified settings, and/or transmit the overdrive request to the telemetry controller to implement the identified settings. Any combination of settings may be identified and used in combination to control a pulser in any operating mode of the tool drill string to provide desired outcomes in view of any parameters.

The training engine 130 may be a rackmount server, a router computer, a personal computer, a portable digital assistant, a smartphone, a laptop computer, a tablet computer, a netbook, a desktop computer, an Internet of Things (IOT) device, any other desired computing device, or any combination of the above. The training engine 130 may be cloud-based, be a real-time software platform, include privacy software or protocols, and/or include security software or protocols.

To generate the one or more machine learning models 132, the training engine 130 may train the one or more machine learning models 132. The training engine 130 may use a base training dataset of settings (e.g., pulse overdrive percentages, survey baud rates, sliding baud rates, high-resolution M-Ary encoding enable/disable setting, etc.) and parameters (e.g., condition of the tool drill string, condition of the formation, condition of the weather, condition of a telemetry channel, etc.) and labels that classify any suitable combination of the settings for any suitable combination of the parameters that provide a desired outcome (e.g., higher data rate, higher amount of data included in a data packet, etc.). For example, once trained, a machine learning model 132 may determine for parameters including a certain weather and downhole device condition, a pulse overdrive percentage should be set to 50% and a survey data rate should be set to 1.5 bits/second for a desired outcome (e.g., highest data rate and magnitude of pressure pulse). The identified settings may be transmitted to the telemetry controller to be implemented.

The one or more machine learning models 132 may refer to model artifacts created by the training engine 130 using training data that includes training inputs and corresponding target outputs. The training engine 130 may find patterns in the training data wherein such patterns map the training input to the target output and generate the machine learning models 132 that capture these patterns. Although depicted separately from the server 128, in some embodiments, the training engine 130 may reside on server 128. Further, in some embodiments, the artificial intelligence engine 140, the database 150, and/or the training engine 130 may reside on the computing device 102.

As described in more detail below, the one or more machine learning models 132 may comprise, e.g., a single level of linear or non-linear operations (e.g., a support vector machine (SVM)) or the machine learning models 132 may be a deep network, i.e., a machine learning model comprising multiple levels of non-linear operations. Examples of deep networks are neural networks, including generative adversarial networks, convolutional neural networks, recurrent neural networks with one or more hidden layers, and fully connected neural networks (e.g., each neuron may transmit its output signal to the input of the remaining neurons, as well as to itself). For example, the machine learning model may include numerous layers and/or hidden layers that perform calculations (e.g., dot products) using various neurons. In some embodiments, one or more of the machine learning models 132 may be long short-term memory (LSTM), which is an artificial recurrent neural network architecture that uses feedback connections. It can not only process single data points, but also entire sequences of data (e.g., a signal of MWD telemetry data).

Figure 2A:
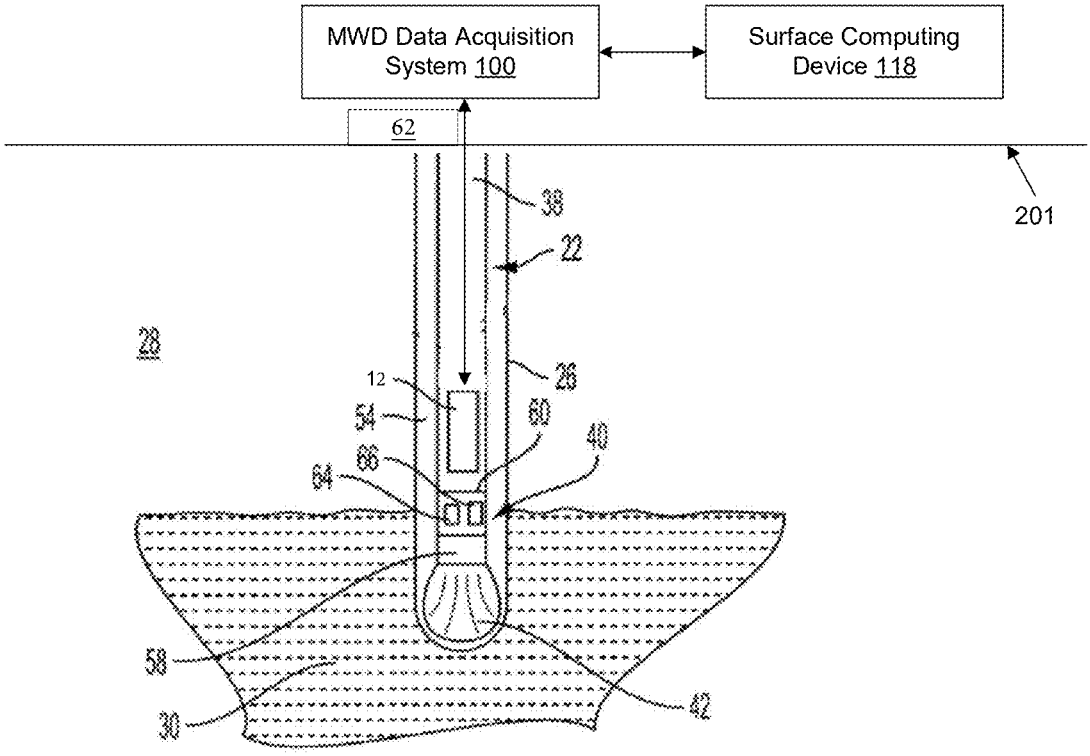
FIG. 2A is a block diagram of a tool drill string, according to embodiments of the disclosure.

FIG. 2A is a block diagram of a tool drill string 22, according to embodiments of the disclosure. The system 10 includes the borehole drill string 22 and a rig for drilling a well borehole 26 through earth 28 and into a formation 30. After the well borehole 26 has been drilled, fluids such as water, oil, and gas can be extracted from the formation 30. In some embodiments, the rig 24 is situated on a platform that is on or above water for drilling into the ocean floor.

In one example, the rig (not depicted) includes a derrick, a derrick floor, a rotary table, and the drill string 22. The drill string 22 includes a drill pipe 38 and a drilling assembly 40 attached to the distal end of the drill pipe 38 at the distal end of the drill string 22.

The drilling assembly 40 includes a drill bit 42 at the bottom of the drilling assembly 40 for drilling the well borehole 26.

A fluidic medium, such as drilling mud, is used by the system for drilling the well borehole 26. The fluidic medium circulates through the drill string 22 and back to the fluidic medium source, which is usually at the surface 201. In embodiments, drilling mud is drawn from a mud pit and circulated by a mud pump through a mud supply line and into a swivel. The drilling mud flows down through an axial central bore in the drill string 22 and through jets (not shown) in the lower face of the drill bit 42. Borehole fluid 54, which contains drilling mud, formation cuttings, and formation fluid, flows back up through the annular space between the outer surface of the drill string 22 and the inner surface of the well borehole 26 to be returned to the mud pit through a mud return line. A filter (not shown) can be used to separate formation cuttings from the drilling mud before the drilling mud is returned to the mud pit. In some embodiments, the drill string 22 has a downhole drill motor 58, such as a mud motor, for rotating the drill bit 42.

In embodiments, the system 10 includes a first module 60 and a second module 62 that are configured to communicate with one another, such as with the first module 60 situated downhole in the well borehole 26 and the second module 62 at the surface. In embodiments, the system 10 includes the first module 60 situated at the distal end of the drill pipe 38 and the drill string 22, and the second module 62 attached to the drill rig 24 at the proximal end of the drill string 22 at the surface. In embodiments, the first module 60 is configured to communicate with the device 14, such as through a wired connection or wirelessly.

The first module 60 includes a downhole processor 64 (e.g., telemetry controller) and a pulser 66, such as a mud pulse valve, communicatively coupled, such as by wire or wirelessly, to the downhole processor 64 (e.g., telemetry controller). The telemetry controller 64 is communicatively coupled to the pulser 66. The pulser 66 is configured to provide a pressure pulse in the fluidic medium in the drill string 22, such as the drilling mud. The MWD tool 12 is communicatively coupled to the MWD data acquisition system 100 and the surface computing device 118.

In some embodiments, the pressure pulse is an acoustic signal and the pulser 66 is configured to provide an acoustic signal that is transmitted to the surface through one or more transmission pathways. These pathways can include the fluidic medium in the drill string 22, the material such as metal that the pipe is made of, and one or more other separate pipes or pieces of the drill string 22, where the acoustic signal can be transmitted through passageways of the separate pipes or through the material of the separate pipes or pieces of the drill string 22. In embodiments, the MWD data acquisition system 100 and/or the surface computing device 118 may include an acoustic signal sensor configured to receive the acoustic signal and communicatively coupled, such as by wire or wirelessly, to the surface processor.

Each of the downhole processor 64 and the surface processor is a computing machine that includes memory that stores executable code that can be executed by the computing machine to perform processes and functions of the system 10. In embodiments, the computing machine is one or more of a computer, a microprocessor, and a micro-controller, or the computing machine includes multiples of a computer, a microprocessor, and/or a micro-controller. In embodiments, the memory is one or more of volatile memory, such as random access memory (RAM), and non-volatile memory, such as flash memory, battery-backed RAM, read only memory (ROM), varieties of programmable read only memory (PROM), and disk storage. Also, in embodiments, each of the first module 60 and the second module 62 includes one or more power supplies for providing power to the module.

Figure 2B:
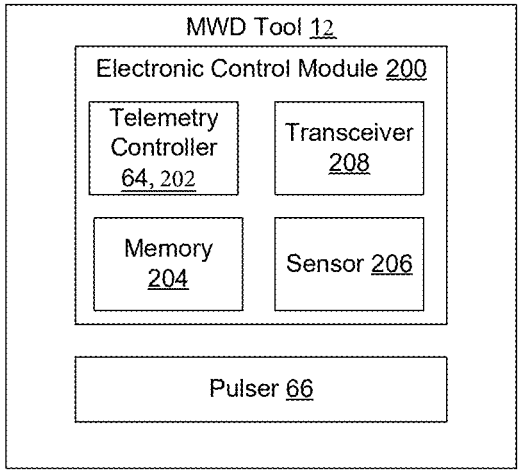
FIG. 2B is a block diagram of components of a measurement while drilling tool, according to embodiments of the disclosure.

FIG. 2B is a block diagram of components of a MWD tool 12, according to embodiments of the disclosure. The MWD tool 12 may include electronic control module 200. The electronic control module 200 may include various electronic components, such as the telemetry controller 202, a memory 204, a sensor 206, and/or a transceiver 208 (e.g., capable of transmitting messages via mud pulse and/or electromagnetic telemetry), among other suitable components. The MWD tool 12 may be communicatively coupled to the MWD data acquisition system 100 when the MWD tool 12 is in operation (e.g., downhole). The MWD data acquisition system 100 may be communicatively coupled to the surface computing device 118. Although depicted as separate and distinct components in FIG. 2B, it should be understood that, in some embodiments, the MWD data acquisition system 100 is a component within the surface computing device 118. In some embodiments, the surface computing device 118 and the MWD data acquisition system 100 may be located relatively closely to the well borehole including the MWD tool 12.

The telemetry controller 202 may be configured to transmit messages via a wireless protocol in various transmission modes. For example, the telemetry controller 202 may command the transceiver 208 to transmit mud pulse messages when operating in a mud pulse mode. The telemetry controller 202 may command the transceiver 208 to transmit electromagnetic (EM) messages when operating in an EM mode. Mud pulse mode is able to operate over a wider range of lithological conditions due to its formation independence. Mud pulse telemetry may refer to a system of using valves to modulate the flow of drilling fluid in a bore of the drill string 22. The valve restriction can generate a pressure pulse that propagates up the column of fluid inside the drill string and then can be detected by pressure transducers at the MWD data acquisition system 100. The EM mode enables data transmission without a continuous fluid column, providing an alternative to negative and positive pulse systems. An EM telemetry system may refer to a system that applies a differential voltage, positive and negative voltage, across an insulative gap in the drill string. The differential voltage causes current to flow through the formation creating equipotential lines that can be detected by sensors at the surface. Due to the formation dependence, EM communication can be hindered by particularly high and low conductivity environments.

The telemetry controller 202 may be any suitable processing device, such as one or more general-purpose processing devices such as a microprocessor, central processing unit, or the like. More particularly, the telemetry controller 202 may be a complex instruction set computing (CISC) microprocessor, reduced instruction set computing (RISC) microprocessor, very long instruction word (VLIW) microprocessor, or a processor implementing other instruction sets or processors implementing a combination of instruction sets. The telemetry controller 202 may also be one or more special-purpose processing devices such as an application specific integrated circuit (ASIC), a system on a chip, a field programmable gate array (FPGA), a digital signal processor (DSP), network processor, or the like. The telemetry controller 202 is configured to execute instructions for performing any of the operations and steps of any of the methods discussed herein. The telemetry controller 202 may control the pulser 66. The telemetry controller 202 may be communicatively coupled with the transceiver 208, the memory 204, and/or the sensor 206.

The memory 204 may be any suitable memory device, such as a tangible, non-transitory computer-readable medium storing instructions. The instructions may implement any operation or steps of any of the methods described herein. The telemetry controller 202 may be communicatively coupled to the memory 204 and may execute the instructions to perform any operation or steps of any of the methods described herein.

The sensor 206 may be any suitable sensor. In some embodiments, the sensor 206 may be an accelerometer, pressure, velocity sensor, proximity probe, laser displacement sensor, magnetometer, or any suitable sensor configured to measure vibrations, pressure, or the like. The sensor 206 may obtain vibration measurements and use them to determine an amount of fluid flow. The sensor 206 may transmit the vibration measurements to the telemetry controller 202. The telemetry controller 202 and/or the sensor 206 may be configured to determine the amount of fluid flow based on the measurements. In some embodiments, the data received from the sensor 206 may be any suitable MWD data and may be received by the telemetry controller 202 and transmitted, via the transceiver 208, to the MWD data acquisition system 100. In some embodiments, based on the amount of fluid flow, the telemetry controller 202 may transmit one or more commands to the pulser 66 to cause the pulser 66 to transmit one or more pressure pulses according to one or more settings (e.g., pulse overdrive percentage, multi-baud rate encoding, high-resolution M-Ary encoding, etc.).

Figure 2C:
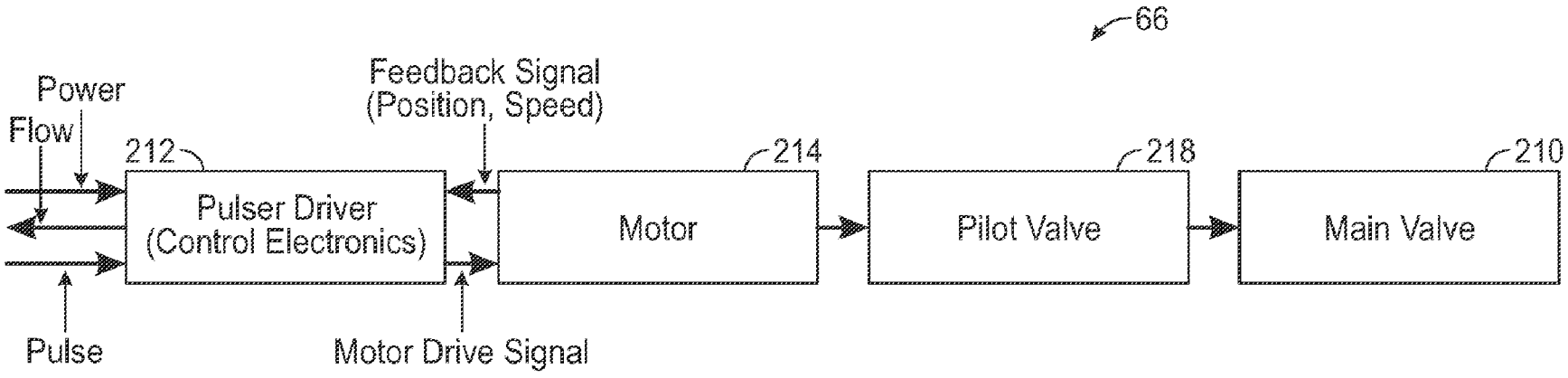
FIG. 2C is a block diagram of an example pulser including a motor, according to embodiments of the disclosure.
Figure 2D:
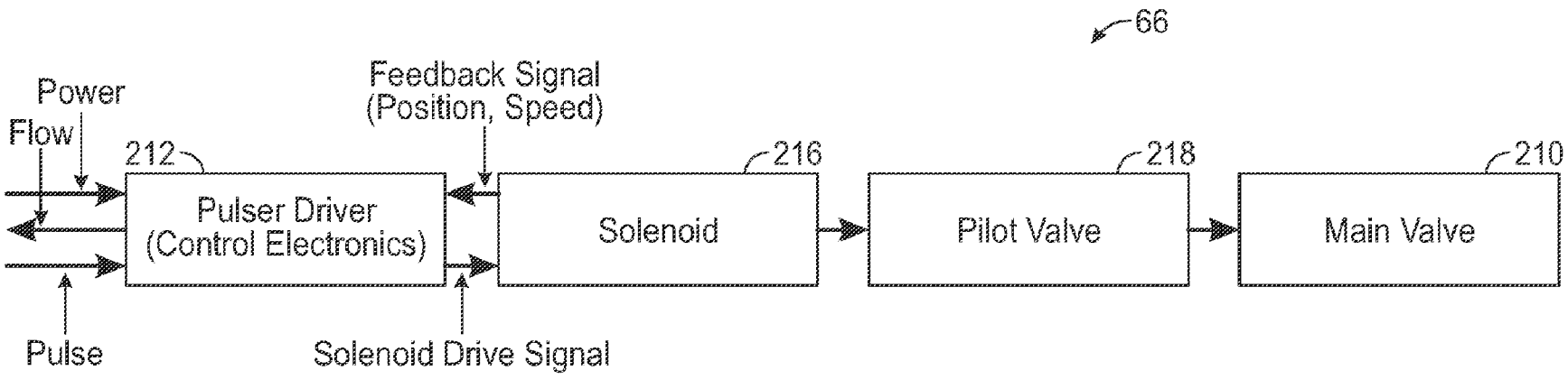
FIG. 2D is a block diagram of an example pulser including a solenoid, according to embodiments of the disclosure.

One of the pulser's 66 operations is to create pressure pulses in the mud being pumped down the drill pipe, such that those pressure pulses can be measured on surface and decoded by the surface processor. The pulser 66 does this by opening and closing a main valve 210 (FIG. 2C) downhole. Note that the main valve 210 does not ever fully obstruct the flow, but can obstruct typically a range of flow (e.g., 70-90%) of a flow area. The longer the main valve is closed, the higher the pressure gets in the drill pipe until it reaches a maximum pressure attainable with the given flow area that is not blocked. As depicted in FIGS. 2C and 2D, the pulser 66 has the following main components: the pulser driver 212, the actuator (solenoid 216 in FIG. 2D or motor 214 in FIG. 2C), the pilot valve 218, and the main valve 210.

The pulser driver 212 is the control electronics of the pulser 66. This electronics module may interface with the rest of the components of the MWD tool 12 and what drives the electronic actuator 212, which is either a solenoid or an electric motor (e.g., brushed DC motor, brushless DC motor, servo motor, etc.). The actuator 212 opens or closes the pilot valve 218, which provides the hydraulic power to open and close the main valve 210.

The pulser driver 212 has one output signal, which is the flow signal. This is a digital output that is high when the pulser driver 212 detects flow in the drill pipe, and low otherwise. This is typically determined based on a measured increase in the vibration as measured by the pulser driver's 212 accelerometers which indicates that fluid is flowing in the drill pipe. Another method is a pressure-based flow switch, which uses a pressure sensor to detect whether the pressure is above a certain threshold, if so, then the flow signal is driven high. When flow is high, the MWD's telemetry controller 64 then begins to toggle the pulse line, which is a digital input to the pulser driver 212 and a digital output of the telemetry controller 64. The telemetry controller 64 drives the pulse line high when it wants the pulser driver to close the valve, and drives it low when it wants the pulser driver 212 to open the valve. The timing between pulses and the on time of the pulse line is what encodes the MWD measurements.

Pulse Overdrive

Figure 3:
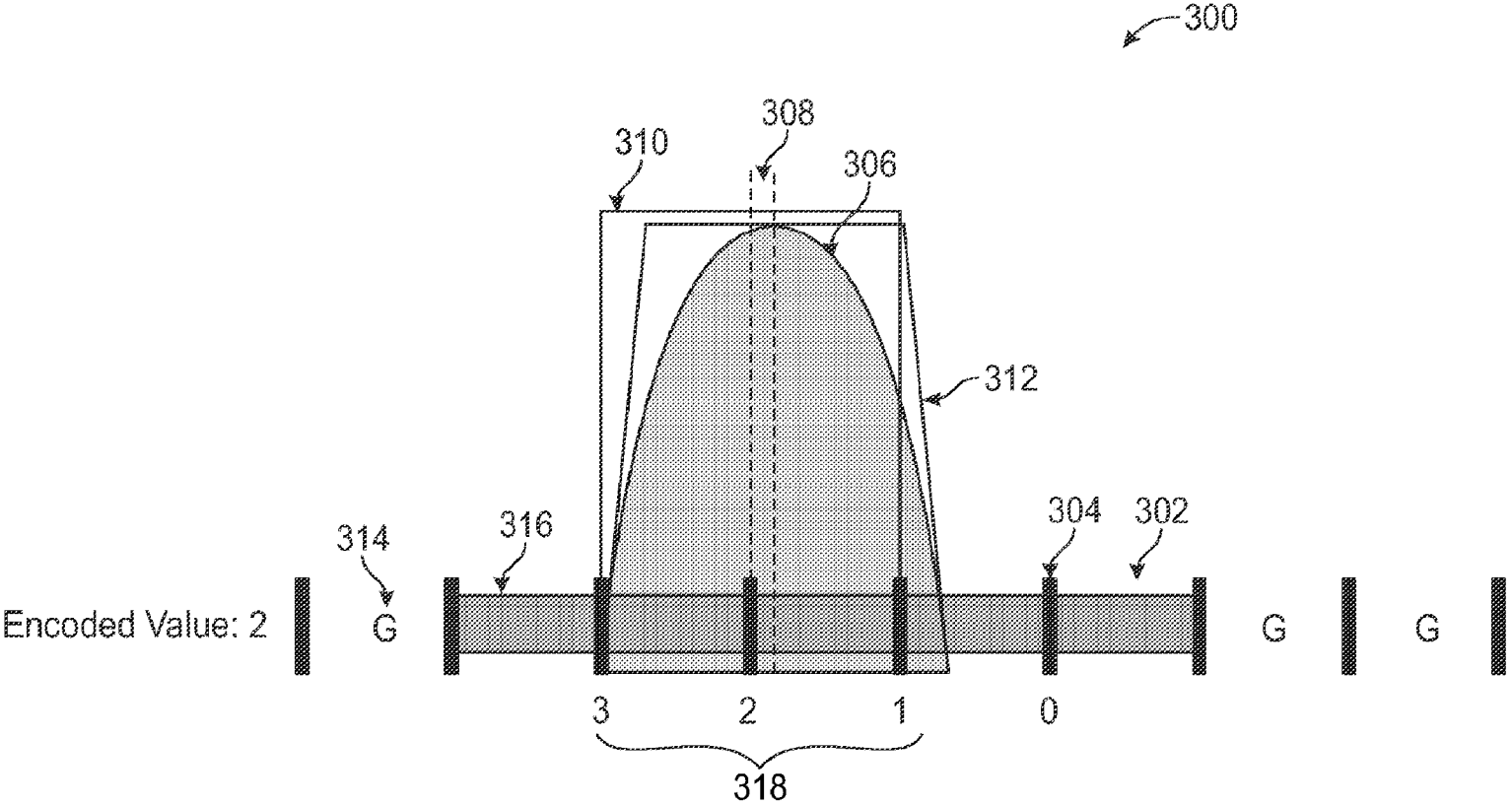
FIG. 3 illustrates a 2-bit M-Ary data packet, according to embodiments of the disclosure.

FIG. 3 illustrates a 2-bit M-Ary data packet 300, according to embodiments of the disclosure.

A time slot 302, indicated by a black vertical line 304 with a number underneath, over which a commanded pulse is centered (e.g., dashed lines 308) indicates a value that is being encoded, in this case, the encoded value is 2. Line 310 represents a commanded pulse by the telemetry controller 64, and the line 312 represents the actual movement of the value, while line 306 represents what the nominal surface waveform will look like. There may be a phase delay between the commanded pulse and the valve action. This phase delay may not affect the ability of the surface processor to decode the data, as the delay may be present in transmissions and may be simply be ignored on surface. The "G's" in the diagram represent guard slots 314, which in an M-Ary encoding that serves to not contain any pulses. In some M-Ary specifications, the guard slot is 1 time unit (TU) wide, and the pulse is required to be 2 TU's wide. This mechanism is present to ensure that there is sufficient spacing between pulses for the hydraulic system to settle. As depicted, a data window 316 is included in the data packet 300. The data window 316 contains each of the time units 304. The commanded pulse may include a first pulse width 318.

Figure 4:
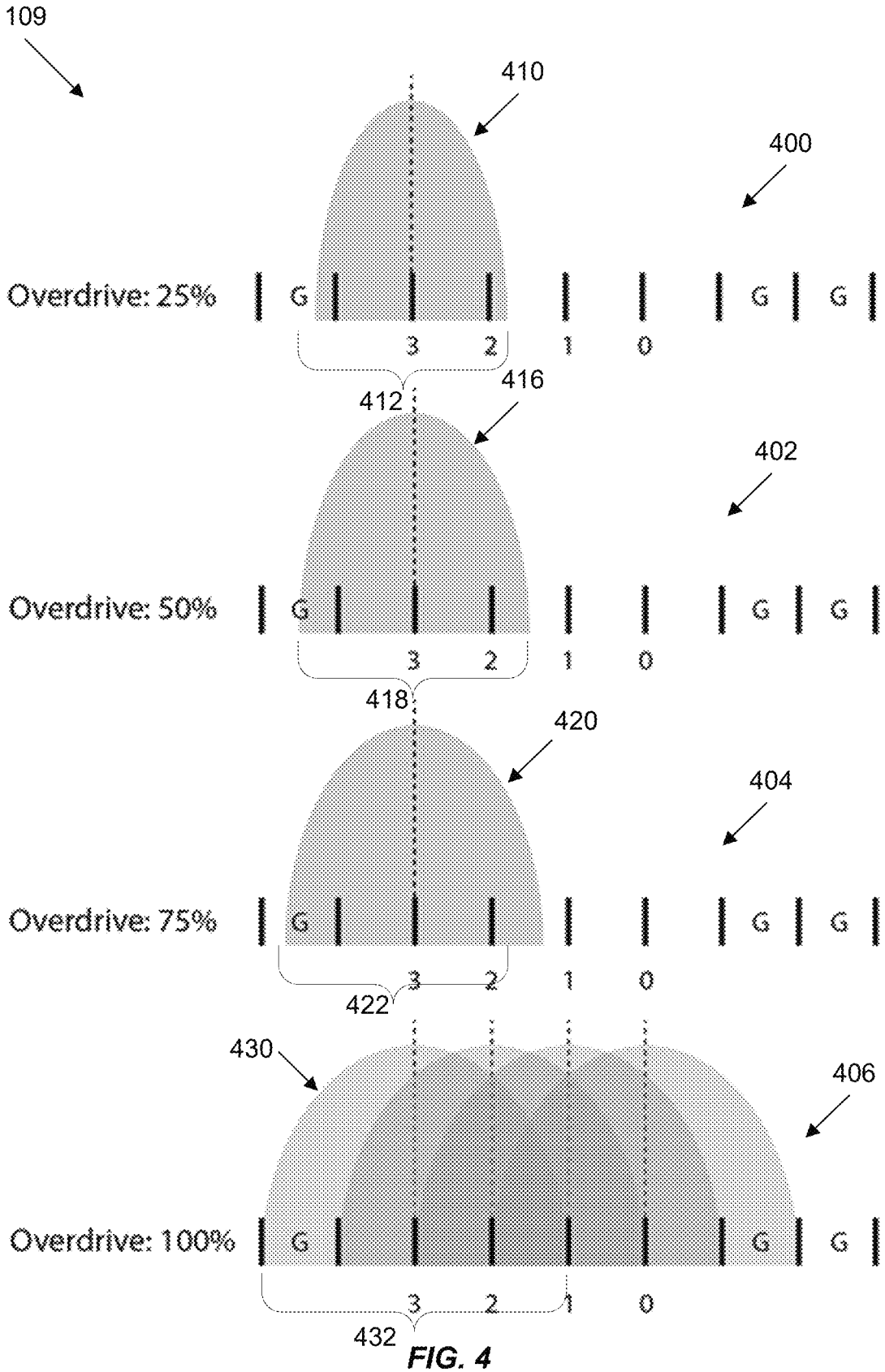
FIG. 4 illustrates an example of 25%, 50%, 75%, and 100% pulse overdrive percentage, according to embodiments of the disclosure.

FIG. 4 illustrates an example of 25%, 50%, 75%, and 100% pulse overdrive percentage, according to embodiments of the disclosure. Each of the examples data rates 400, 402, 404, and 406 include the same time units and guard slots in a data window of a data packet as the data packet 300 of FIG. 3.

The pulse overdrive feature modifies the M-Ary specification and eliminates the requirement that no pulses be present in the guard slots. When a pulse overdrive percentage is used, all the size of the time units and overall telemetry timing remains the same regardless of the pulse overdrive percentage. The overdrive percentage can be 25%, 50%, 75%, and 100%. For example, in the 25% overdrive case, the pulse 410 is still centered in the same position, but has a second pulse width 412 that increases the first pulse width 318 by 25%, while the data rate 400 stays the same. For example, in the 50% overdrive case, the pulse 416 is still centered in the same position, but has a second pulse width 418 that increases the first pulse width 318 by 50%, while the data rate 402 stays the same. For example, in the 75% overdrive case, the pulse 420 is still centered in the same position, but has a second pulse width 422 that increases the first pulse width 318 by 75%, while the data rate 404 stays the same. For example, in the 100% overdrive case, the pulse 430 is still centered in the same position, but has a second pulse width 432 that increases the first pulse width 318 by 100%, while the data rate 406 stays the same. In the 100% overdrive case, there is a potential for the end of a pulse encoded as a 0 to be only one guard slot away from another pulse encoded as a 3.

As the pulser 64 begins to close the main valve 210, the pressure in the drill pipe begins to rise. The longer the main valve 210 is closed, the higher the pressure rises (to a point). So, in conventional M-Ary encoding, there is a trade-off between pulse width and data rate, and the pulse width directly affects the data rate to surface. A larger pulse width gets you a larger pressure pulse at the surface processor, since the main valve 310 is closed longer, but it also slows down the data rate. Whereas a shorter pulse width gets you a faster data rate but reduces the magnitude of the pressure pulse received at the surface processor. The location of the peak of the pressure pulse, which is the information that is needed for decoding by the surface processor, can be determined with very high accuracy (e.g., within 5-10 ms).

Therefore, the disclosed embodiments may increase the width of the pulses using pulse overdrive percentages and maintain the same time slot spacing (e.g., data rate) to increase the pulse magnitude on surface for a given data rate. This technique overcomes the previous trade-off between pulse magnitude on surface and the data rate and decouples the two factors. Thus, the disclosed embodiments provide a technical solution to a technical problem.

Figure 7:
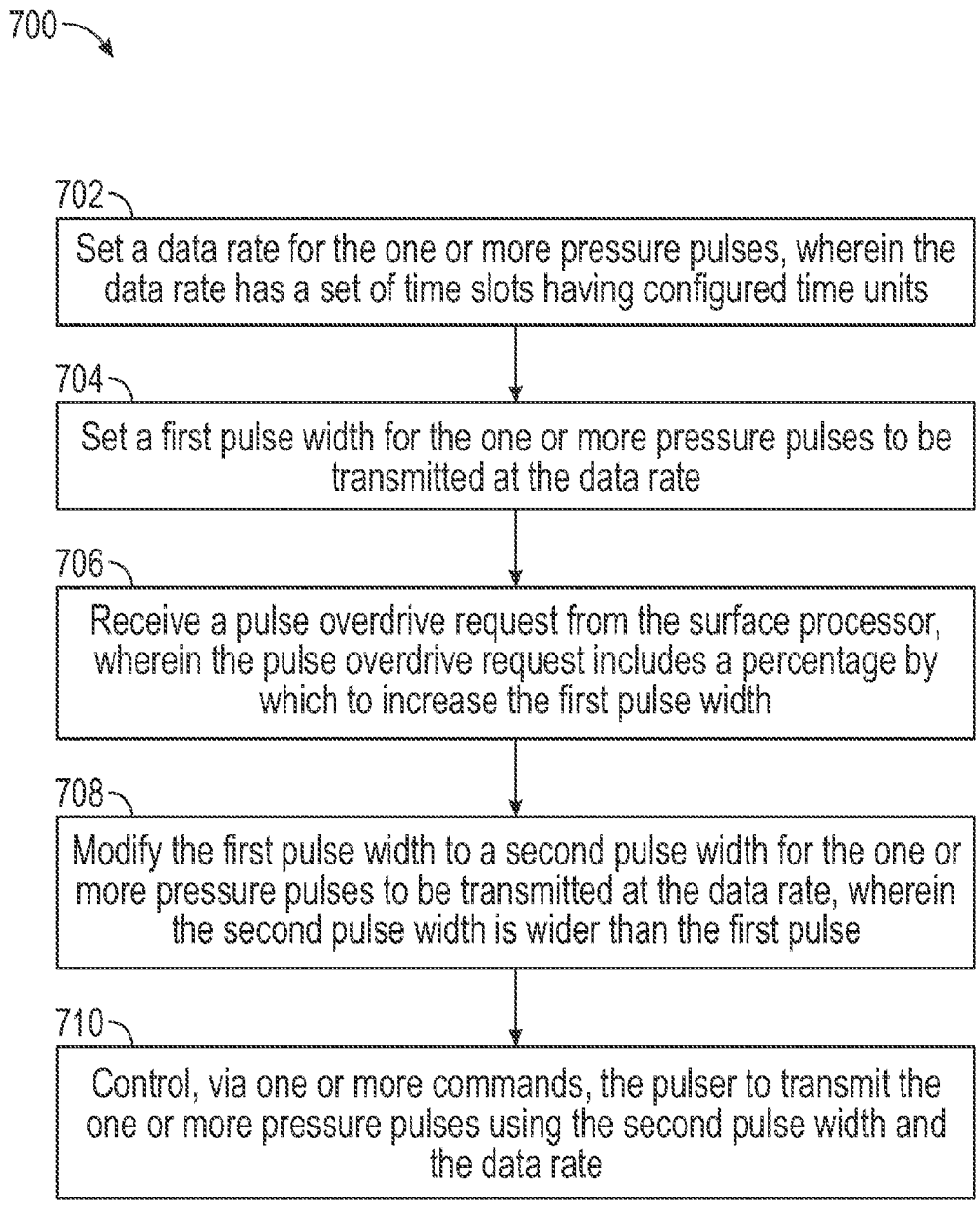
FIG. 7 illustrates a method of using pulse overdrive, according to embodiments of the disclosure.

FIG. 7 illustrates a method 700 of using pulse overdrive, according to embodiments of the disclosure. The method 700 is performed by processing logic that may include hardware (circuitry, dedicated logic, etc.), software (such as is run on a general-purpose computer system or a dedicated machine), or a combination of both. The method 700 and/or each of its individual functions, routines, subroutines, or operations may be performed by one or more processors of a computing device (e.g., any component of FIG. 1, such as server 128 executing the artificial intelligence engine 140, surface computing device 118; any component of FIGS. 2A-2D, such as surface computing device 118, telemetry controller 202, pulser 66, or the like). In certain implementations, the method 700 may be performed by a single processing thread. Alternatively, the method 700 may be performed by two or more processing threads, each thread implementing one or more individual functions, routines, subroutines, or operations of the methods.

For simplicity of explanation, the method 700 is depicted and described as a series of operations. However, operations in accordance with this disclosure can occur in various orders and/or concurrently, and/or with other operations not presented and described herein. For example, the operations depicted in the method 700 may occur in combination with any other operation of any other method disclosed herein. Furthermore, not all illustrated operations may be required to implement the method 700 in accordance with the disclosed subject matter. In addition, those skilled in the art will understand and appreciate that the method 700 could alternatively be represented as a series of interrelated states via a state diagram or events.

At 702, the telemetry controller 202 may set a data rate for the one or more pressure pulses. The data rate has a set of time slots having configured time units. The one or more pressure pulses are centered over a time slot having a first width.

At 704, the telemetry controller 202 may set a first pulse width for the one or more pressure pulses to be transmitted at the data rate.

At 706, the telemetry controller 204 may receive a pulse overdrive request from the surface processor. The pulse overdrive request may include a percentage by which to increase the first pulse width. In some embodiments, the overdrive percentage (e.g., 25%, 50%, 75%, 100%) may be pre-programmed using a user interface of the surface computing device. In some embodiments, the downhole device may be operating in a well, and the surface processor is configured to execute instructions to transmit a message to the telemetry controller 64 to modify the overdrive percentage. In some embodiments, the pulse overdrive request may be generated by a trained machine learning model generated by an artificial intelligence engine. In some embodiments, the trained machine learning model may receive one or more parameters related to a condition of the downhole device, a condition of a telemetry channel, a condition of a well in which the downhole device is disposed, a weather condition, a condition of another system, or some combination thereof. In some embodiments, a closed loop feedback system may increase the overdrive percentage to achieve a desired pulse pressure. The trained machine learning modem ay generate the pulse overdrive request and the percentage based on the one or more parameters.

At 708, the telemetry controller 204 may modify the first pulse width to a second pulse width for the one or more pressure pulses to be transmitted at the data rate. The second pulse width is wider than the first pulse width. The first and second pressure pulses may both be positioned centered around the same time slot having the same width. That is the time slot's width remains unchanged when the second pulse width is used for the second pulse.

At 710, the telemetry controller 204 may control, via one or more commands, the pulser 66 to transmit the one or more pressure pulses using the second pulse width and the data rate. The data rate stays the same between the one or more pulses having the first pulse width and the second pulse width that are different widths. The one or more commands may be transmitted to the pulser driver 212. The one or more commands may include a pulse and/or power and/or the overdrive percentage desired. In some embodiments, the one or more commands may be executed during at least one guard slot in a data packet, wherein the data packet encodes a value of one of the one or more pressure pulses. In some embodiments, at least one guard slot in the data packet does not include a pressure pulse, the data packet comprises a set of time slots, and the guard slot and the set of time slots are respective time units.

In some embodiments, the pulse overdrive embodiment disclosed may be used in any suitable combination with the multi-baud rate embodiment and/or the high-resolution M-Ary encoding embodiment disclosed herein.

Multi-Baud Rate Encoding

Figure 5:
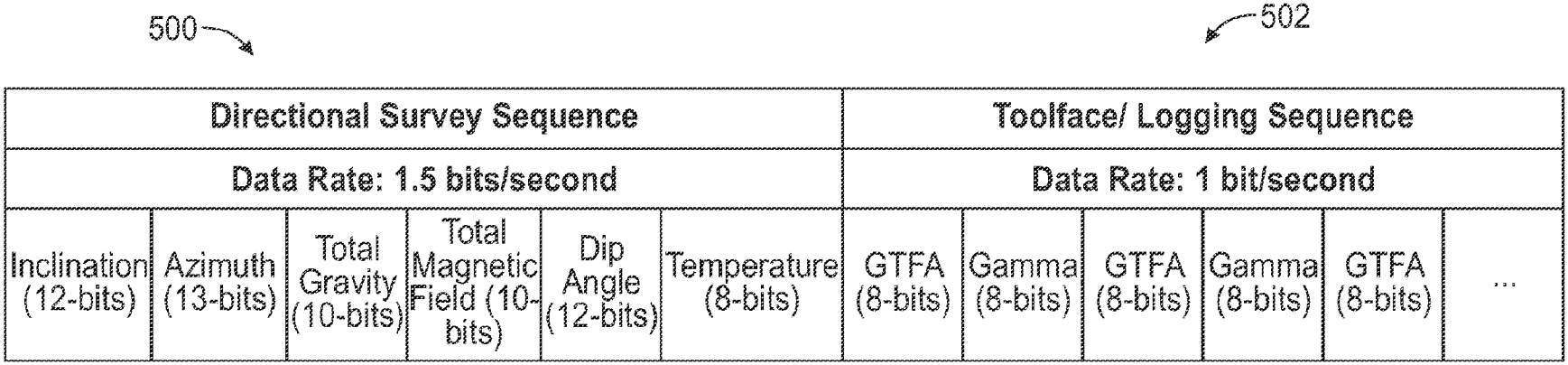
FIG. 5 illustrates an example of multi-baud rate telemetry sequences, according to embodiments of the disclosure.

FIG. 5 illustrates an example of multi-baud rate telemetry sequences 500 and 502, according to embodiments of the disclosure.

There are three primary MWD telemetry modes: survey, sliding, and rotating. In typical drilling conditions, after an entire section of drill pipe, known as a stand, has been drilled down, the drill bit 42 is lifted off bottom, and a new segment of drill pipe is added to the drill string 22. During this time, the drill string 22 is stationary, and the downhole Measurement While Drilling (MWD) tool 12 takes a directional survey measurement (e.g., inclination and azimuth of the wellbore). After the new pipe segment has been added, the mud pumps are turned back on and driller may wait for the MWD tool 12 to transmit the directional survey to the surface processor before beginning to drill ahead. After the directional survey has been received, the driller lowers the drill string 22 back onto the bottom of the wellbore and begins drilling ahead. While drilling ahead, the drill bit 42 is in contact with the rock formation and the drill bit 42 is rotating.

There are two modes of operation while drilling ahead: sliding, and rotating. When sliding, the drill pipe is not rotating, only the drill bit 42 is rotating, being driven by the mud motor which converts the drilling mud flow into rotational energy. Sliding is used to change the direction of the wellbore. When rotating, the entire drill string 22 rotates in addition to the rotation of the mud motor, this is used when the driller wants to drill straight ahead without changing direction.

The pressure pulses sent from downhole while the drill string 22 is off bottom (i.e., the drill bit 42 is not in contact with the formation) may have a higher signal to noise ratio (SNR) than when the drill string 22 is on bottom. The reason for the difference in SNR is due to several factors, including the increased vibration and variation in the drill bit 42 speed, which in the presence of a mud motor will also directly affect the pressure in the drill pipe, which will be seen on surface. Drilling vibration and electrical rig noise is also higher when drilling ahead. These, and other factors, contribute to a reduced SNR while drilling ahead.

After the survey has been received at the surface processor, and the driller begins to drill ahead, the MWD tool 12 switches into transmitting what is known as toolface or logging sequences. The MWD tool 12 typically sends either what is known as a toolface sequence or a logging sequence. The toolface sequence contains information to allow the directional driller to steer the well. This is typically sent while the driller is sliding (i.e., the drill string 22 is on bottom and the mud pumps are on, but the drill string 22 is not rotating, only the drill bit 42 is rotating due to the rotation of the mud motor, driven by the mud flow). Logging sequences on the other hand typically include gamma measurements and other well logging information that is transmitted while the drill bit 42 is on bottom and drilling ahead with the drill string 22 rotating.

These toolface or logging sequences are a continuous stream of data that the MWD tool 12 will continue to send as long as the mud pumps are on and/or the driller continues to drill ahead and until the next directional survey is acquired. Conventional MWD tools can only be configured to send both the directional survey information and the toolface or logging information at the same data rate.

The disclosed multi-baud rate embodiment may leverage the fact that the SNR is higher when the directional survey is transmitted while the drill string 22 is off bottom than when the toolface or logging information is transmitted, and the drill string 22 is on bottom. This operational detail may be used by the telemetry controller 64 to transmit the directional survey at a faster data rate than it transmits the toolface or logging information. This takes advantage of an available communication channel, by maximizing the rate at which data is sent while the channel noise is low and reducing the data rate as the channel noise increases. An example of the data rates for the directional survey sequence versus the toolface or logging sequence is shown below in FIG. 5. For example, a directional survey sequence (e.g., first information sequence) may be configured to be transmitted at a first data rate (e.g., 1.5 bits/second) that is faster than a second data rate (e.g., 1 bit/second) used to transmit a second information sequence (e.g., toolface or logging sequence).

There can be different data rates for survey, sliding, and rotating, since all three of these can have different SNR environments.

Figure 8:
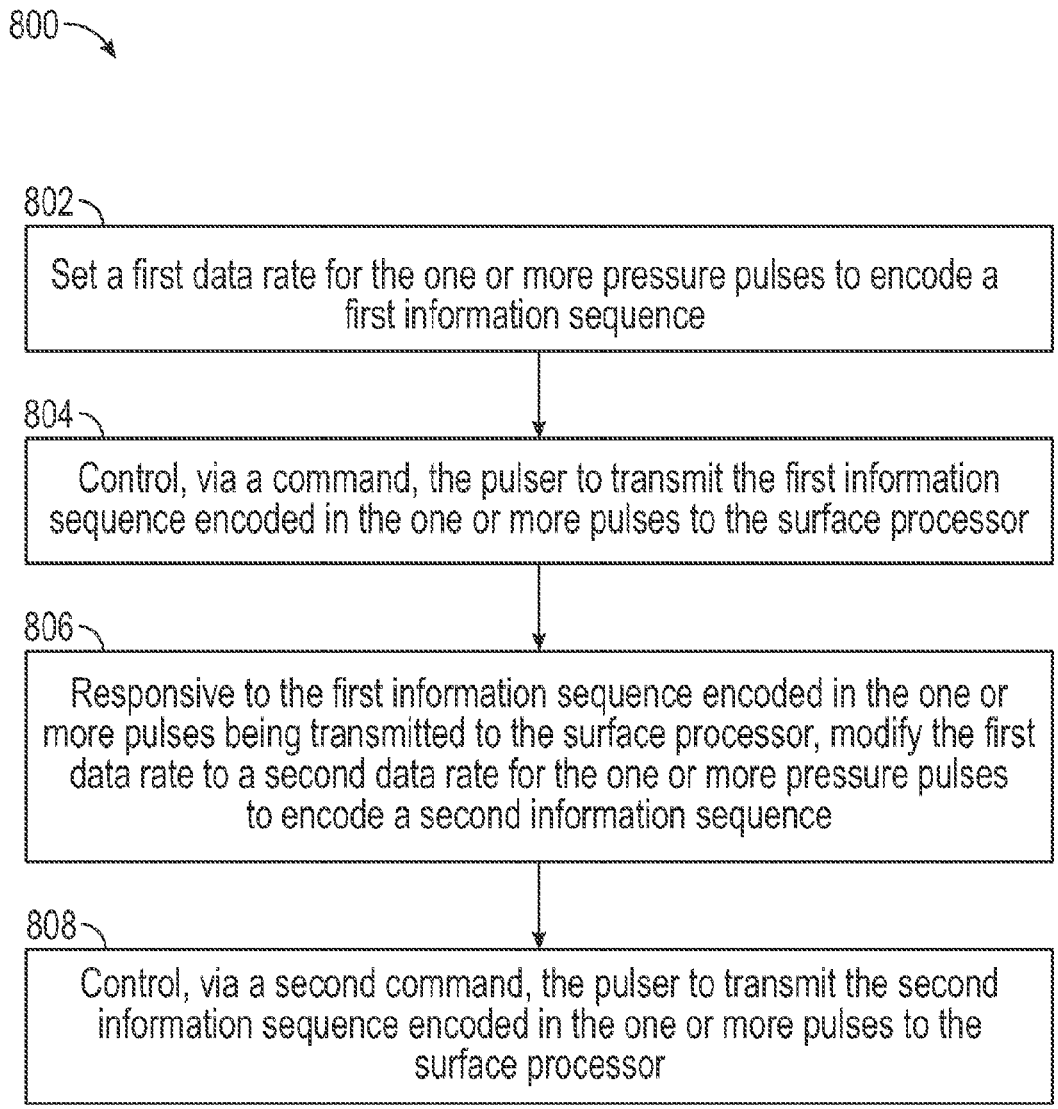
FIG. 8 illustrates a method of using a multi-baud rate encoding, according to embodiments of the disclosure.

FIG. 8 illustrates a method 800 of using a multi-baud rate encoding, according to embodiments of the disclosure. The method 800 may be performed in the same or a similar manner as described above in regards to method 700. The operations of the method 800 may be performed in some combination with any of the operations of any of the methods described herein.

In some embodiments, a system may be configured to use the method 800. The system may include a surface processor, a telemetry controller 202 communicatively coupled to the surface processor, and a pulser 66 configured to actuate to transmit one or more pressure pulses to the surface processor. The pulser 66 may be communicatively coupled to the telemetry controller 202. At 802, the telemetry controller 202 may set a first data rate for the one or more pressure pulses to encode a first information sequence. In some embodiments, the first information sequence pertains to directional survey information.

At 804, the telemetry controller 204 may control, via a command, the pulser 66 to transmit the first information sequence encoded in the one or more pulses to the surface processor.

At 806, responsive to the first information sequence encoded in the one or more pulses being transmitted to the surface processor, the telemetry controller 40 may modify the first data rate to a second data rate for the one or more pressure pulses to encode a second information sequence. In some embodiments, the second information sequence may pertain to toolface information or logging information. When the second information sequence pertains to the toolface information it may include information enable a driller (e.g., a user or computer operating the tool drill string 22) to steer a well and is sent when a drill bit is in contact with a formation and the drill bit 42 is rotating in a sliding mode. When the second information sequence pertains to the logging information it may include information such as gamma measurements and is sent when the tool drill string is in contact with a formation and the tool drill string 22 is rotation. In some embodiments, the first data rate is set during a first operating mode (e.g., surveying) of the tool drill string 22, wherein during the first operating mode a drill bit 42 is not in contact with a formation, and the second data rate is set during a second operating mode (e.g., rotating or sliding) of the tool drill string 22, wherein during the second operating mode the drill bit 42 is in contact with the formation. The first data rate is higher than the second data rate.

At 808, the processing device may control, via a second command, the pulser 66 to use the second data rate to transmit the second information sequence encoded in the one or more pulsers 40 to the surface processor. The first information sequence is transmitted at a different data rate than the second information sequence. In some embodiments, the second data rate is modified to a third data rate by a trained machine learning model generated by the artificial intelligence engine. In some embodiments, the multi-baud rate embodiment disclosed may be used in any suitable combination with the pulse overdrive embodiment and/or the high-resolution M-Ary encoding embodiment disclosed herein.

High-Resolution M-Ary Encoding

Figure 6:
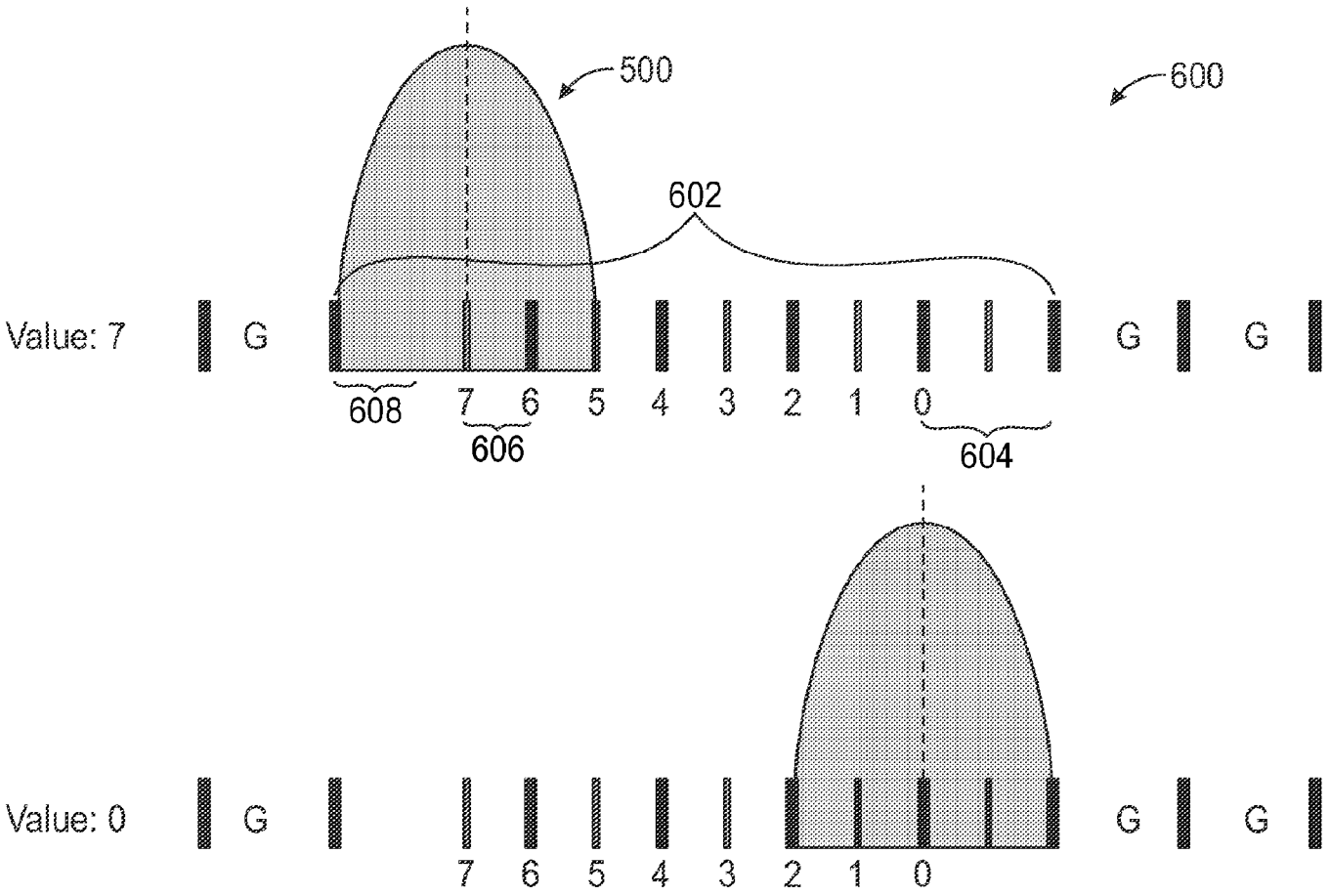
FIG. 6 illustrates an example of high-resolution M-Ary encoding, according to embodiments of the disclosure.

FIG. 6 illustrates an example of high-resolution M-Ary encoding, according to embodiments of the disclosure.

Conventional M-Ary specification for telemetry in MWD tools specifies that the pressure pulse must fall within 1 time unit (TU) section of time, where the pulse width is defined as 2 TU's. A peak of the pressure pulse can be measured with a very high accuracy using modern data acquisition and signal processing techniques, there is a potential for increasing the resolution of the pulse peak location without changing the pulse width. An embodiment of high-resolution M-Ary encoding timing configuration is shown below in FIG. 6. In some embodiments of the high-resolution M-Ary encoding, the pulse location may be measured with an accuracy of ½ TU or better. In some embodiments, the TU may be other amounts. This high-resolution M-Ary encoding scheme may increase (e.g., nearly double) the data contained in the total time it would normally take to transmit a standard 2-bit M-Ary packet.

In some embodiments, the high-resolution M-Ary encoding scheme may be enabled by modifying a data window 602 of a data frame 600. The data window includes a set of TUs 604 (each represented by two thick black lines), and the telemetry controller 64 may modifies the data window 602 my dividing each TU 604 of the set of Tus 604 by a certain amount (e.g., ½) to create shorter length TUs 606. The telemetry controller 64 may be configured to extend the data window by adding another shorter length TU having the certain amount (e.g., ½) as shown by 608. Thus, instead of having 8 TUs, the data frame 600 depicted includes 8 and ½ TUs.

In some embodiments, The MWD data acquisition system 100 may include a decoder and adaptive filters to enable identifying very accurate pulse widths. A model may be used to model conditions of a transmission line with inputs and outputs to set up a band pass filter at a certain frequency. Further, a multipath filter may be used that accounts for the limited bandwidth (e.g., 0.2 Hertz-10 Hertz) which uses a statistical approach that generates a certain number (e.g., hundreds, thousands, etc.) of relevant filters based on the bandwidth, conditions of the transmission line with inputs and outputs, etc. The multipath filter may generate every path that a transmission line may statistically go. This may be performed on a word by word basis. Then the multipath filter may determine which of the relevant filters is returning the most desirable information (e.g., data rate, pulse width, amount of data, etc.). The selected filter may be used.

Figure 9:
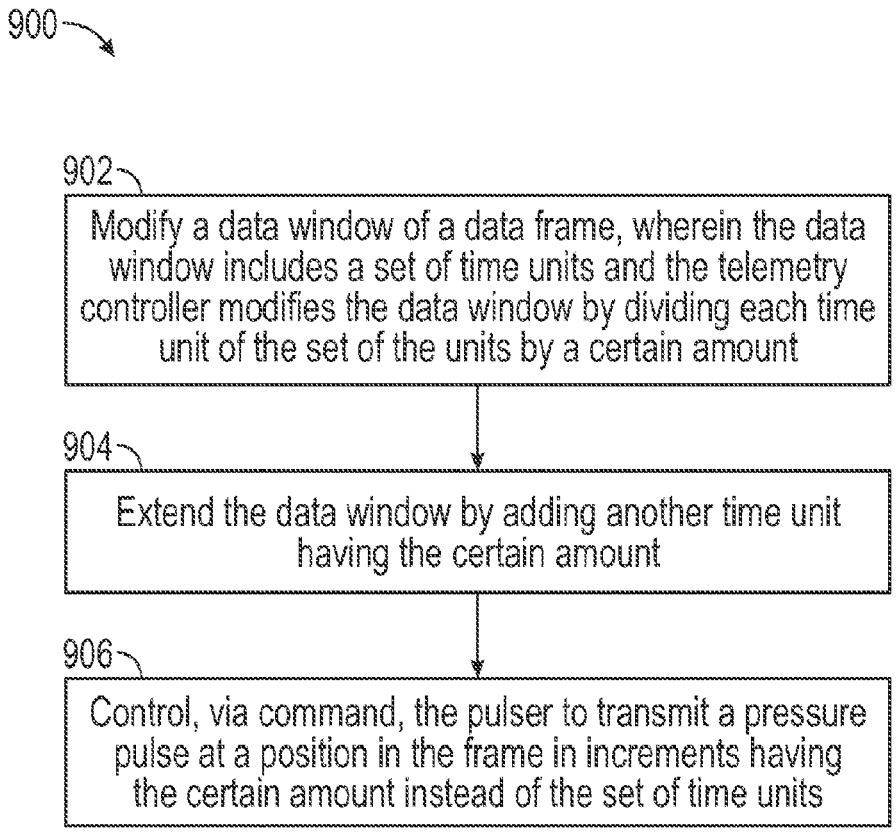
FIG. 9 illustrates a method of using high-resolution M-Ary encoding, according to embodiments of the disclosure.

FIG. 9 illustrates a method of using high-resolution M-Ary encoding, according to embodiments of the disclosure. The method 900 may be performed in the same or a similar manner as described above in regards to method 700. The operations of the method 900 may be performed in some combination with any of the operations of any of the methods described herein.

At 902, the telemetry controller 202 may modify a data window of a data frame. The data window may include a set of time units and the telemetry controller 202 may modify the data window by dividing each time unit of the plurality of time units by a certain amount.

At 904, the telemetry controller 202 may extend the data window by adding another time unit having the certain amount.

At 906, the telemetry controller 202 may control, via a command, the pulser 66 to transmit a pressure pulse at a position in the data frame in increments having the certain amount instead of the set of time units.

In some embodiments, the high-resolution M-Ary encoding embodiment disclosed may be used in any suitable combination with the pulse overdrive embodiment and/or the multi-baud rate embodiment disclosed herein. In some embodiments, the telemetry controller 64 is configured to cause the pulser 66 to modify a pulse width of the pressure pulse by a certain percentage, while maintaining the data frame. In some embodiments, the telemetry controller 64 is configured to cause the pulser 66 to modify a data rate of pressure pulses when the tool drill string is operating in different modes.

Figure 10:
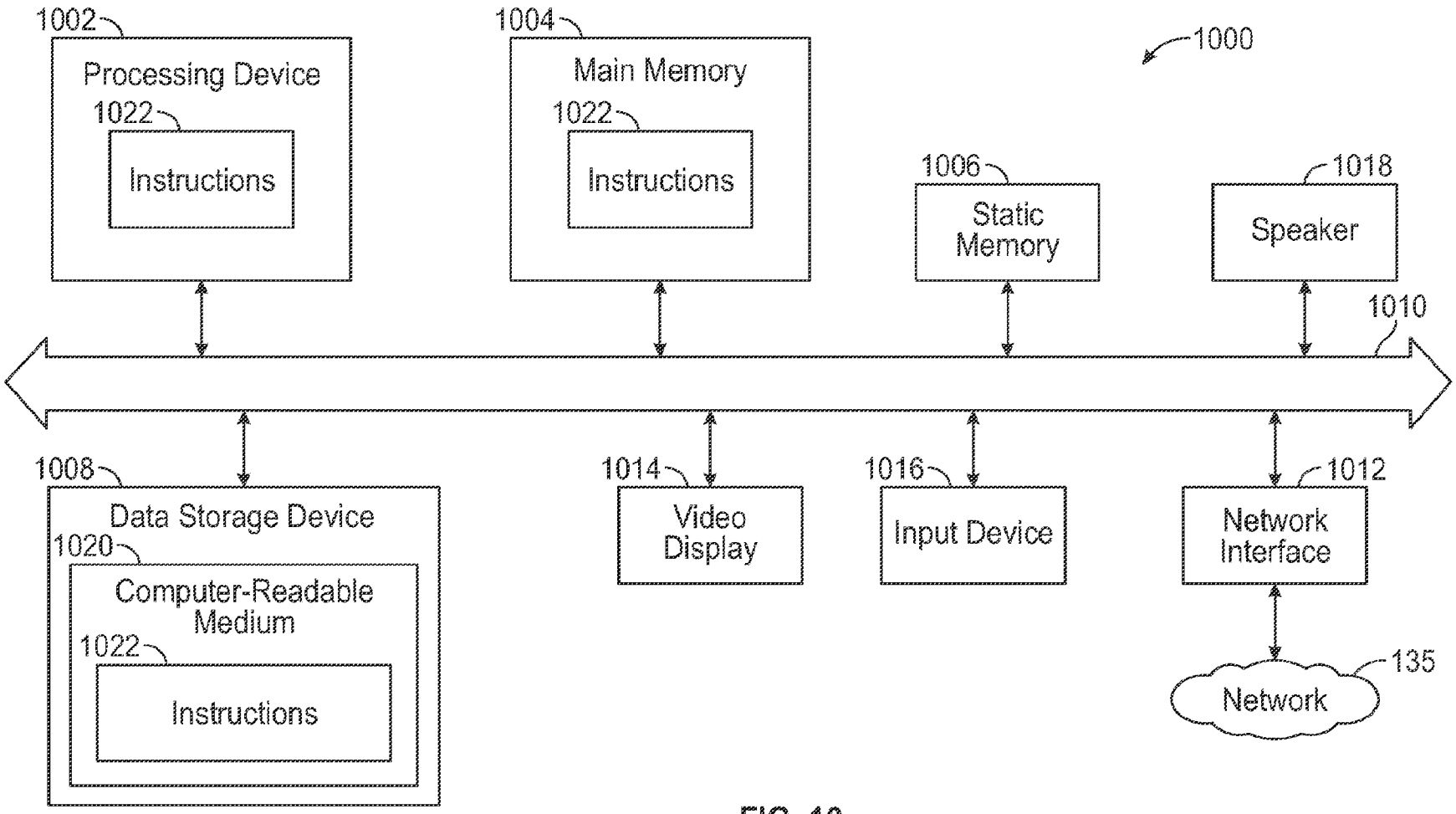
FIG. 10 illustrates an example computer system according to the present disclosure.

FIG. 10 shows an example computer system 1000 which can perform any one or more of the methods described herein, in accordance with one or more aspects of the present disclosure. In one example, computer system 1000 may correspond to the surface computing device 118 (e.g., user computing device), one or more servers 128 of the cloud-based computing system 116, the training engine 130, the MWD data acquisition system 100, the MWD tool 12, the pulser 66, or any suitable component of FIG. 1. The computer system 1000 may be capable of executing an application that presents any of the user interfaces described herein, training the one or more machine learning models 132, and/or executing the one or more machine learning models 132 of FIG. 1. The computer system may be connected (e.g., networked) to other computer systems in a LAN, an intranet, an extranet, or the Internet. The computer system may operate in the capacity of a server in a client-server network environment. The computer system may be a personal computer (PC), a tablet computer, a wearable (e.g., wristband), a set-top box (STB), a personal Digital Assistant (PDA), a mobile phone, a camera, a video camera, or any device capable of executing a set of instructions (sequential or otherwise) that specify actions to be taken by that device. Further, while only a single computer system is illustrated, the term "computer" shall also be taken to include any collection of computers that individually or jointly execute a set (or multiple sets) of instructions to perform any one or more of the methods discussed herein.

The computer system 1000 includes a processing device 1002, a main memory 1004 (e.g., read-only memory (ROM), flash memory, solid state drives (SSDs), dynamic random access memory (DRAM) such as synchronous DRAM (SDRAM), a static memory 1006 (e.g., flash memory, solid state drives (SSDs), static random access memory (SRAM)), and a data storage device 1008, which communicate with each other via a bus 1010.

Processing device 1002 represents one or more general-purpose processing devices such as a microprocessor, central processing unit, or the like. More particularly, the processing device 1002 may be a complex instruction set computing (CISC) microprocessor, reduced instruction set computing (RISC) microprocessor, very long instruction word (VLIW) microprocessor, or a processor implementing other instruction sets or processors implementing a combination of instruction sets. The processing device 1002 may also be one or more special-purpose processing devices such as an application specific integrated circuit (ASIC), a system on a chip, a field programmable gate array (FPGA), a digital signal processor (DSP), network processor, or the like. The processing device 1002 is configured to execute instructions for performing any of the operations and steps discussed herein.

The computer system 1000 may further include a network interface device 1012. The computer system 1000 also may include a video display 1014 (e.g., a liquid crystal display (LCD), a light-emitting diode (LED), an organic light-emitting diode (OLED), a quantum LED, a cathode ray tube (CRT), a shadow mask CRT, an aperture grille CRT, a monochrome CRT), one or more input devices 1016 (e.g., a keyboard and/or a mouse), and one or more speakers 1018 (e.g., a speaker). In one illustrative example, the video display 1014 and the input device(s) 1016 may be combined into a single component or device (e.g., an LCD touch screen).

The data storage device 1016 may include a computer-readable medium 1020 on which the instructions 1022 embodying any one or more of the methods, operations, or functions described herein is stored. The instructions 1022 may also reside, completely or at least partially, within the main memory 1004 and/or within the processing device 1002 during execution thereof by the computer system 1000. As such, the main memory 1004 and the processing device 1002 also constitute computer-readable media. The instructions 1022 may further be transmitted or received over a network 135 via the network interface device 1012.

While the computer-readable storage medium 1020 is shown in the illustrative examples to be a single medium, the term "computer-readable storage medium" should be taken to include a single medium or multiple media (e.g., a centralized or distributed database, and/or associated caches and servers) that store the one or more sets of instructions. The term "computer-readable storage medium" shall also be taken to include any medium that is capable of storing, encoding or carrying a set of instructions for execution by the machine and that cause the machine to perform any one or more of the methodologies of the present disclosure. The term "computer-readable storage medium" shall accordingly be taken to include, but not be limited to, solid-state memories, optical media, and magnetic media.

Consistent with the above disclosure, the examples of systems and method enumerated in the following clauses are specifically contemplated and are intended as a non-limiting set of examples.

1. A system including a tool drill string having a downhole device, the system comprising:
   - a surface processor;
   - a telemetry controller communicatively coupled to the surface processor; and
   - a pulser configured to actuate to transmit one or more pressure pulses to the surface processor, wherein the pulser is communicatively coupled to the telemetry controller, and the telemetry controller is configured to:
   - set a data rate for the one or more pressure pulses, wherein the data rate has a plurality of time slots having configured time units;
   - set a first pulse width for the one or more pressure pulses to be transmitted at the data rate;
   - receive a pulse overdrive request from the surface processor, wherein the pulse overdrive request comprises a percentage by which to increase the first pulse width;
   - modify the first pulse width to a second pulse width for the one or more pressure pulses to be transmitted at the data rate, wherein the second pulse width is wider than the first pulse width; and
   - control, via one or more commands, the pulser to transmit the one or more pressure pulses using the second pulse width and the data rate.

2. The system of any clause herein, wherein the pulse overdrive request is generated by a trained machine learning model generated by an artificial intelligence engine.

3. The system of any clause herein, wherein the trained machine learning model:
   - receives one or more parameters related to a condition of the downhole device, a condition of a telemetry channel, a condition of a well in which the downhole device is disposed, a weather condition, a condition of another system, or some combination thereof, and
   - generates the pulse overdrive request and the percentage based on the one or more parameters.

4. The system of any clause herein, wherein one of the one or more commands is executed during at least one guard slot in a data packet, wherein the data packet encodes a value of one of the one or more pressure pulses.

5. The system of any clause herein, wherein at least one guard slot in the data packet does not include a pressure pulse, the data packet comprises a plurality of time slots, and the plurality of time slots are respective time units.

6. The system of any clause herein, wherein, while the downhole device is operating in a well, the surface processor is configured to execute instructions to transmit a message to the telemetry controller to modify the percentage.

7. The system of any clause herein, wherein the surface processor receives a selection of the percentage from a user interface.

8. The system of any clause herein, wherein the percentage comprises 25%, 50%, 75%, or 100%.

9. The system of any clause herein, wherein the first and second pressure pulses are both positioned in the same position centered about the same time slot.

10. A system including a tool drill string having a downhole device, the system comprising:
   - a surface processor;
   - a telemetry controller communicatively coupled to the surface processor; and
   - a pulser configured to actuate to transmit one or more pressure pulses to the surface processor, wherein the pulser is communicatively coupled to the telemetry controller, and the telemetry controller is configured to:
   - set a first data rate for the one or more pressure pulses to encode a first information sequence;
   - control, via a command, the pulser to transmit the first information sequence encoded in the one or more pulses to the surface processor;
   - responsive to the first information sequence encoded in the one or more pulses being transmitted to the surface processor, modify the first data rate to a second data rate for the one or more pressure pulses to encode a second information sequence;
   - control, via a second command, the pulser to use the second data rate to transmit the second information sequence encoded in the one or more pulses to the surface processor.

11. The system of any clause herein, wherein the first data rate is set during a first operating mode of the tool drill string, wherein during the first operating mode a drill bit is not in contact with a formation, and the second data rate is set during a second operating mode of the tool drill string, wherein during the second operating mode the drill bit is in contact with the formation.

12. The system of any clause herein, wherein the first data rate is higher than the second data rate.

13. The system of any clause herein, wherein the first information sequence pertains to directional survey information, and the second information sequence pertains to toolface information or logging information.

14. The system of any clause herein, wherein the second information sequence pertains to the toolface information comprising information to enable a directional driller to steer a well and is sent when a drill bit is in contact with a formation and the drill bit is rotating in a sliding mode.

15. The system of any clause herein, wherein the second information sequence pertains to the logging information comprising gamma measurements and is sent when the tool drill string is in contact with a formation and the tool drill string is rotating.

16. The system of any clause herein, wherein the first information sequence is transmitted at a different data rate than the second information sequence.

17. The system of any clause herein, wherein the second data rate is modified to a third data rate by a trained machine learning model generated by an artificial intelligence engine.

18. The system of any clause herein, wherein the trained machine learning model:

receives one or more parameters related to a condition of the downhole device, a condition of a well in which the downhole device is disposed, a weather condition, a condition of another system, a condition pertaining to channel noise, or some combination thereof, and modifies, based on the one or more parameters, the second data rate to the third data rate for the one or more pressure pulses to encode a third information sequence.

19. A system including a tool drill string having a downhole device, the system comprising:

a surface processor;

a telemetry controller communicatively coupled to the surface processor; and a pulser configured to actuate to transmit one or more pressure pulses to the surface processor, wherein the pulser is communicatively coupled to the telemetry controller, and the telemetry controller is configured to:

modify a data window of a data frame, wherein the data window comprises a plurality of time units and the telemetry controller modifies the data window by dividing each time unit of the plurality of time units by a certain amount; and control, via a command, the pulser to transmit a pressure pulse at a position in the data frame in increments having the certain amount instead of the plurality of time units.

20. The system of any clause herein, wherein the telemetry controller is configured to extend the data window by adding another time unit having the certain amount.

21. The system of any clause herein, wherein the telemetry controller is configured to modify a pulse width of the pressure pulse by a certain percentage, while maintaining the data frame.

22. The system of any clause herein, wherein the telemetry controller is configured to modify a data rate of pressure pulses when the tool drill string is operating in different modes.

What is claimed is:

1. A system including a tool drill string having a downhole device, the system comprising:

a surface processor;

a telemetry controller communicatively coupled to the surface processor; and a pulser configured to actuate to transmit one or more pressure pulses to the surface processor, wherein the pulser is communicatively coupled to the telemetry controller, and the telemetry controller is configured to:

set a data rate for the one or more pressure pulses, wherein the data rate has a plurality of time slots having configured time units;

set a first pulse width for the one or more pressure pulses to be transmitted at the data rate, wherein the one or more pressure pulses are centered over a time slot having a first width;

receive a pulse overdrive request from the surface processor, wherein the pulse overdrive request comprises a percentage by which to increase the first pulse width;

modify the first pulse width to a second pulse width for the one or more pressure pulses to be transmitted at the data rate, wherein the second pulse width is wider than the first pulse width; and control, via one or more commands, the pulser to transmit the one or more pressure pulses using the second pulse width and the data rate, wherein the one or more pressure pulses having the second pulse width are centered over the time slot having the first width.

2. The system of claim 1, wherein the pulse overdrive request is generated by a trained machine learning model generated by an artificial intelligence engine.

3. The system of claim 2, wherein the trained machine learning model:

receives one or more parameters related to a condition of the downhole device, a condition of a telemetry channel, a condition of a well in which the downhole device is disposed, a weather condition, a condition of another system, or some combination thereof, and generates the pulse overdrive request and the percentage based on the one or more parameters.

4. The system of claim 1, wherein one of the one or more commands is executed during at least one guard slot in a data packet, wherein the data packet encodes a value of one of the one or more pressure pulses.

5. The system of claim 4, wherein at least one guard slot in the data packet does not include a pressure pulse, the data packet comprises a plurality of time slots, and the plurality of time slots are respective time units.

6. The system of claim 1, wherein, while the downhole device is operating in a well, the surface processor is configured to execute instructions to transmit a message to the telemetry controller to modify the percentage.

7. The system of claim 1, wherein the surface processor receives a selection of the percentage from a user interface.

8. The system of claim 1, wherein the percentage comprises 25%, 50%, 75%, or 100%.

9. The system of claim 1, wherein the first and second pressure pulses are both positioned in the same position centered about the same time slot.

10. A system including a tool drill string having a downhole device, the system comprising:

a surface processor;

a telemetry controller communicatively coupled to the surface processor; and a pulser configured to actuate to transmit one or more pressure pulses to the surface processor, wherein the pulser is communicatively coupled to the telemetry controller, and the telemetry controller is configured to:

set a first data rate for the one or more pressure pulses to encode a first information sequence;

control, via a command, the pulser to transmit the first information sequence encoded in the one or more pulses to the surface processor;

responsive to the first information sequence encoded in the one or more pulses being transmitted to the surface processor, modify the first data rate to a second data rate for the one or more pressure pulses to encode a second information sequence, wherein the first information sequence pertains to directional survey information, and the second information sequence pertains to toolface information or logging information;

control, via a second command, the pulser to use the second data rate to transmit the second information sequence encoded in the one or more pulses to the surface processor.

11. The system of claim 10, wherein the first data rate is set during a first operating mode of the tool drill string, wherein during the first operating mode a drill bit is not in contact with a formation, and the second data rate is set during a second operating mode of the tool drill string, wherein during the second operating mode the drill bit is in contact with the formation.

12. The system of claim 10, wherein the first data rate is higher than the second data rate.

13. The system of claim 10, wherein the first information sequence is transmitted at a different data rate than the second information sequence.

14. The system of claim 10, wherein the second information sequence pertains to the toolface information comprising information to enable a directional driller to steer a well and is sent when a drill bit is in contact with a formation and the drill bit is rotating in a sliding mode.

15. The system of claim 10, wherein the second information sequence pertains to the logging information comprising gamma measurements and is sent when the tool drill string is in contact with a formation and the tool drill string is rotating.

16. The system of claim 10, wherein the second data rate is modified to a third data rate by a trained machine learning model generated by an artificial intelligence engine.

17. The system of claim 16, wherein the trained machine learning model:

receives one or more parameters related to a condition of the downhole device, a condition of a well in which the downhole device is disposed, a weather condition, a condition of another system, a condition pertaining to channel noise, or some combination thereof, and modifies, based on the one or more parameters, the second data rate to the third data rate for the one or more pressure pulses to encode a third information sequence.

18. A system including a tool drill string having a downhole device, the system comprising:

a surface processor;

a telemetry controller communicatively coupled to the surface processor; and a pulser configured to actuate to transmit one or more pressure pulses to the surface processor, wherein the pulser is communicatively coupled to the telemetry controller, and the telemetry controller is configured to:

set a first data rate for the one or more pressure pulses to encode a first information sequence;

control, via a command, the pulser to transmit the first information sequence encoded in the one or more pulses to the surface processor;

responsive to the first information sequence encoded in the one or more pulses being transmitted to the surface processor, modify the first data rate to a second data rate for the one or more pressure pulses to encode a second information sequence; and control, via a second command, the pulser to use the second data rate to transmit the second information sequence encoded in the one or more pulses to the surface processor, wherein the first data rate is set during a first operating mode of the tool drill string, wherein during the first operating mode a drill bit is not in contact with a formation, and the second data rate is set during a second operating mode of the tool drill string, wherein during the second operating mode the drill bit is in contact with the formation.

19. The system of claim 18, wherein the telemetry controller is configured to extend the data window by adding another time unit having the certain amount.

* * * * *